US008340536B2

(12) United States Patent
Paul et al.

(10) Patent No.: US 8,340,536 B2
(45) Date of Patent: Dec. 25, 2012

(54) PHOTORECEPTOR DIAGNOSTIC METHOD BASED ON DETECTION OF CHARGE DEFICIENT SPOTS

(75) Inventors: Peter Paul, Webster, NY (US); Aaron Michael Burry, Ontario, NY (US); Michael F. Zona, Holley, NY (US); Eric S. Hamby, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 365 days.

(21) Appl. No.: 12/783,251

(22) Filed: May 19, 2010

(65) Prior Publication Data

US 2011/0286753 A1 Nov. 24, 2011

(51) Int. Cl.
*G03G 15/00* (2006.01)

(52) U.S. Cl. ..... 399/26

(58) Field of Classification Search ..... 399/26, 399/43, 48, 128, 159
See application file for complete search history.

(56) References Cited

U.S. PATENT DOCUMENTS 5,175,503 A * 12/1992 Mishra et al. ..... 324/452
5,697,024 A * 12/1997 Mishra ..... 399/128
5,703,487 A * 12/1997 Mishra ..... 324/456
6,150,824 A * 11/2000 Mishra et al. ..... 324/452
6,198,885 B1 * 3/2001 Budnik et al. ..... 399/24
6,272,295 B1 * 8/2001 Lindblad et al. ..... 399/26
7,251,419 B2 * 7/2007 Silvestri et al. ..... 399/26
7,272,330 B2 * 9/2007 Harlan et al. ..... 399/26
2012/0008965 A1 * 1/2012 Lu et al. ..... 399/26

FOREIGN PATENT DOCUMENTS

JP 2007170949 A * 7/2007

* cited by examiner

*Primary Examiner* — Robert Beatty
(74) *Attorney, Agent, or Firm* — MH2 Technology Law Group LLP

(57) ABSTRACT

Systems and methods of diagnosing a photoreceptor associated with an imaging device. The photoreceptor is configured to enter into a diagnostic cycle to complete a set number of cycles. A sensor or array is configured to a scan a component associated with the imaging device during each of the set of cycles to establish defect data. The defect data is analyzed to filter one or more charge deficient spots (CDS) from background noise in the defect data. The systems and methods determine whether the photoreceptor needs replacement based on the determined one or more CDS. The systems and methods are further configured to output a report of the determination. The determination is conducted at fixed or variable intervals throughout the life of the photoreceptor and/or imaging device.

22 Claims, 7 Drawing Sheets

PHOTORECEPTOR DIAGNOSTIC METHOD BASED ON DETECTION OF CHARGE DEFICIENT SPOTS

FIELD OF THE INVENTION

This invention relates to the field of printing and imaging devices, and more particularly to systems and methods for diagnosing a photoreceptor based on a detection of charge deficient spots.

BACKGROUND OF THE INVENTION

Xerographic or electrophotographic image forming methods and systems are used in marking or imaging devices such as copiers, scanners, fax machines, laser printers, multifunction devices, and the like. A photoreceptor of the imaging devices can have a charge transport layer (CTL) that can carry the charge that determines toner placement on a substrate to be copied or printed. Over the lifecycle of the imaging device and corresponding photoreceptor, the CTL can deplete and reduce in thickness, which can cause the photoreceptor to be more susceptible to field breakdown within the CTL. The field breakdown can lead to spot defects known as charge depleted spots (CDS). If an imaging device has an issue with CDS, the substrate outputs produced by the imaging device can have noticeable spots that reduce the accuracy and quality of the prints.

To prevent the occurrence of CDS defects in customer prints, a counter with a programmed or estimated life counter replacement value can be used to trigger the end-of-life and/or replacement for the photoreceptor. For example, imaging devices can have photoreceptors, charging devices, and/or cleaning blades that can be packaged together in a subassembly that can be customer- or service engineer-replaceable. A replacement interval of the subassemblies can drive a large percentage of a run cost of the imaging device, and the life counter replacement value of the photoreceptor can be a driving element for defining a life of the subassemblies. In particular, a population reliability model can be used to set the life counter replacement value for the photoreceptor and the corresponding subassembly, such as, for example, using a "B10" life model. If the imaging device reaches the life counter replacement value, the imaging device can stop printing and the subassembly can be deemed to require replacement. For example, the imagine device can stop printing and can be shipped to a replacement center for replacement.

Because the life counter replacement value of the photoreceptor is affected by a number of customer usage factors, such as, for example, area coverage, environmental conditions, developer age, and job length, the estimated remaining useful life of the photoreceptor may not be accurate. As a result, the photoreceptor may fail, and CDS defects may occur, before the estimated life limit is reached. Further, the photoreceptor may have remaining workable cycles when the estimated life limit is reached.

A need, therefore, exists for systems and methods that allow for a more accurate photoreceptor life limit measurement. Further, a need exists for systems and methods for reducing costs associated with estimated life limits.

SUMMARY OF THE EMBODIMENTS

The following presents a simplified summary in order to provide a basic understanding of some aspects of one or more embodiments of the invention. This summary is not an extensive overview, nor is it intended to identify key or critical elements of the invention nor to delineate the scope of the invention. Rather, its primary purpose is merely to present one or more concepts in simplified form as a prelude to the detailed description presented later.

In accordance with the present teachings, a method of diagnosing a photoreceptor of a device is provided. The method comprises executing a set of cycles of the device, sensing a component associated with the device during each of the set of cycles to establish defect data, and processing the defect data to identify one or more charge deficient spots (CDS) in the defect data. Further, the method comprises determining whether the photoreceptor needs replacement based on the identified one or more CDS.

In accordance with the present teachings, a system for diagnosing a photoreceptor of a device is provided. The photoreceptor is configured to execute a set of cycles. The system comprises a sensor configured to a scan a component associated with the device during each of the set of cycles to establish defect data. Further, the system comprises a processor configured to analyze the defect data to identify one or more charge deficient spots (CDS) in the defect data, and determine whether the photoreceptor needs replacement based on the identified one or more CDS.

BRIEF DESCRIPTION OF THE DRAWINGS

The accompanying drawings, which are incorporated in and constitute a part of this specification, illustrate embodiments of the invention and together with the description, serve to explain the principles of the invention. In the figures.

Figure 1A:
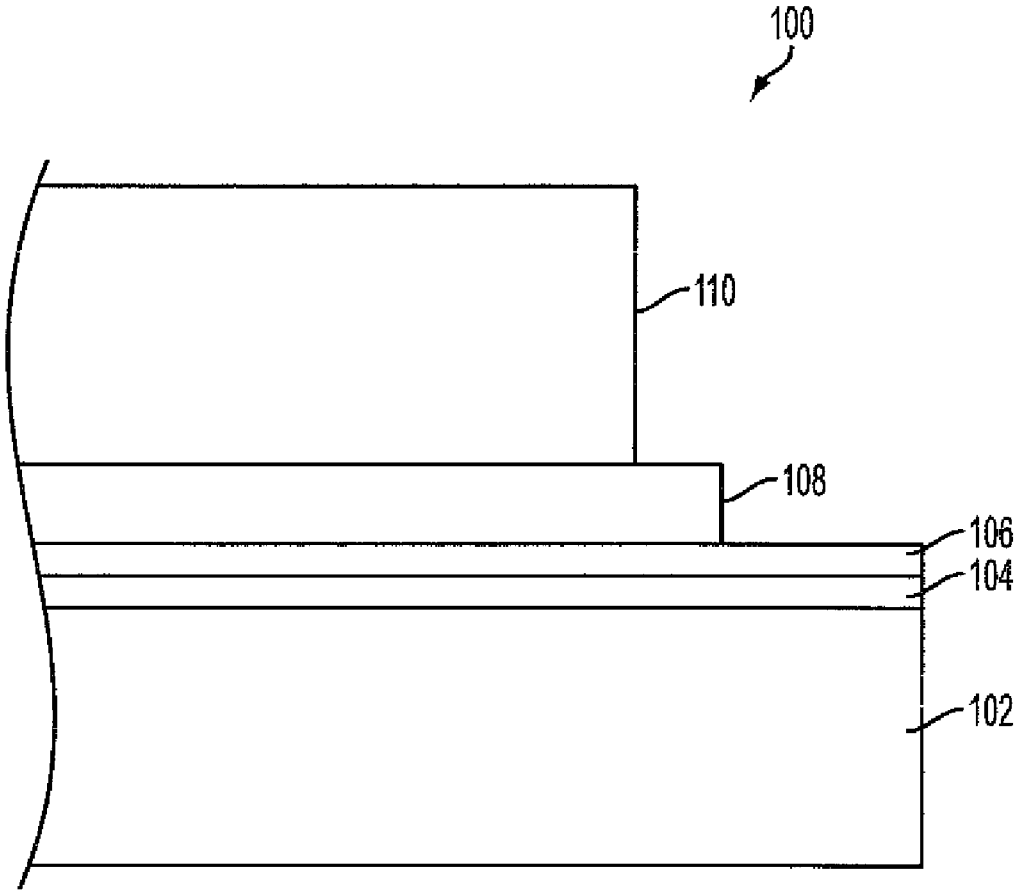
FIG. 1A depicts a cross-section of an imaging member of an exemplary imaging device according to the present teachings.

It should be noted that some details of the drawings have been simplified and are drawn to facilitate understanding of the inventive embodiments rather than to maintain strict structural accuracy, detail, and scale.

DESCRIPTION OF THE EMBODIMENTS

For simplicity and illustrative purposes, the principles of the present teachings are described by referring mainly to exemplary embodiments thereof. However, one of ordinary skill in the art would readily recognize that the same principles are equally applicable to, and can be implemented in, all types of information and systems, and that any such variations do not depart from the true spirit and scope of the present teachings. Moreover, in the following detailed description, references are made to the accompanying figures, which illustrate specific exemplary embodiments. Electrical, mechanical, logical and structural changes may be made to the exemplary embodiments without departing from the spirit and scope of the present teachings. The following detailed description is, therefore, not to be taken in a limiting sense and the scope of the present teachings is defined by the appended claims and their equivalents.

Various embodiments provide systems and methods for determining whether a photoreceptor needs replacement and/or has reached its end-of-life condition. It should be appreciated that various imaging devices can be used in the present embodiments. For example, the imaging device can be a multi-function imaging device comprising a scanner, printer, copier, fax, and/or other features used in imaging operations. In embodiments, the imaging device can incorporate one or more photoreceptors to allow for xerographic or electrophotographic marking technology. It should be appreciated that other similar imaging devices can be used in the present embodiments, of which the components can be combined or standalone entities.

The systems and methods described herein can measure the occurrence of a life-limiting defect for photoreceptors of imaging devices. In embodiments, the systems and methods can measure the amount and size of charge depleted spots (CDS) defects in a charge transport layer (CTL) of a photoreceptor. The measurements can be used to determine whether the photoreceptor has reached its end-of-life condition, or the point at which the photoreceptor has reached a degraded performance level. In embodiments, the end-of-life condition can further be the point at which the photoreceptor can be replaced.

The systems and methods described herein can initiate a diagnostic sequence wherein a set number of photoreceptor cycles or revolutions can be completed. In embodiments, each photoreceptor cycle can be a printing of a document or substrate without any exposure (i.e. a blank document). The printed substrates can comprise spots of toner, which can indicate either CDS defects, or background toner or noise. The systems and methods can comprise a sensor that can directly or indirectly detect the spots of toner on the printed substrates or on other components of an imaging device. In embodiments, the sensor can be disposed near or can sense components related to the imaging device, such as, for example, the photoreceptor, an intermediate belt, or outputted documents or substrates. The components can be sensed during or after each photoreceptor cycle, and the resulting measurements can be processed to filter the CDS defects from the background noise. The number and size of the CDS defects detected can be used in a combined metric to determine if the performance of the photoreceptor has degraded to a point where the photoreceptor or other components should be replaced. The systems and methods can provide an output report of the status of the photoreceptor, and, more particularly, if the photoreceptor or other components need replacement.

According to the present embodiments, a Photoreceptor Coherent Integration Process (PCIP) can be applied on the collected image data and measurements. The PCIP can combine data from the set number of photoreceptor cycles completed by the imaging device to reduce and/or filter out the level of the background noise in the image data. The PCIP can be performed such that the data from the same location on the photoreceptor across all of the photoreceptor cycles is combined together. In embodiments, the combined data from the same location on the photoreceptor across all of the photoreceptor cycles can be averaged. Further, the data combining can be performed separately for each location on the photoreceptor. CDS defects can be filtered from the background noise because the CDS defects can have a consistent location and/or size across the photoreceptor cycles. In contrast, the background noise can have random and varied locations across the photoreceptor cycles.

Further, after the application of the PCIP, a Constant False Alarm Rate (CFAR) can be applied to the image data whereby a sliding local window can be used to determine a local detection threshold in the image data. The local detection threshold can be applied to the image data to locate peaks in the data, which can indicate locations of CDS defects that can have values that can meet or exceed the local detection threshold. It should be appreciated that other processes and algorithms can be applied to the image data to determine the location and size of any CDS defects and/or filter the CDS defects from background noise.

By determining whether the photoreceptor or components thereof should be replaced, the photoreceptor can be run to its near failure point and the total system run cost can be reduced. For instance, by measuring the occurrence of CDS, the photoreceptor can be run to an estimated replacement point instead of to a life counter replacement value. As such, cases in which the life counter replacement value signals replacement of a working photoreceptor that could generate more images can be reduced. Further, cases in which CDS defects occur due to the CTL wearing faster than what the life counter replacement value predicted can be reduced. Further, the amount of service or help calls from customers to a service or help desk can be reduced in cases in which a given customer environment causes higher CTL wear rates than normal. Still further, the estimated actual replacement points can be used to improve understanding of reliability performance of imaging devices, photoreceptors, and other machines, and to reduce costs associated with imaging devices, support services, and the like. Moreover, the CDS measuring systems and methods can be more accurate than existing measuring systems and methods, can be automated, and can be embedded into an imaging device.

Referring to FIG. 1A, depicted is a cross-section of an imaging member of an exemplary imaging device 100 having a drum configuration according to the present embodiments. It should be appreciated, however, that other configurations are contemplated. As shown in FIG. 1A, the exemplary imaging device 100 comprises a support substrate 102, an electrically conductive ground plane 104, an undercoat layer 106, a charge generation layer 108 and a charge transport layer (CTL) 110. The support substrate 102 can be comprised of a material such as, for example, metal, metal alloy, aluminum, zirconium, niobium, tantalum, vanadium, hafnium, titanium, nickel, stainless steel, chromium, tungsten, molybdenum, and mixtures thereof, and other materials. The charge generation layer 108 and the CTL 110 can form an imaging layer described herein as two separate layers. In embodiments, the charge generation layer 108 can be disposed on top of the CTL 110. It should be appreciated that the functional components of these layers can alternatively be combined into a single layer.

Figure 1B:
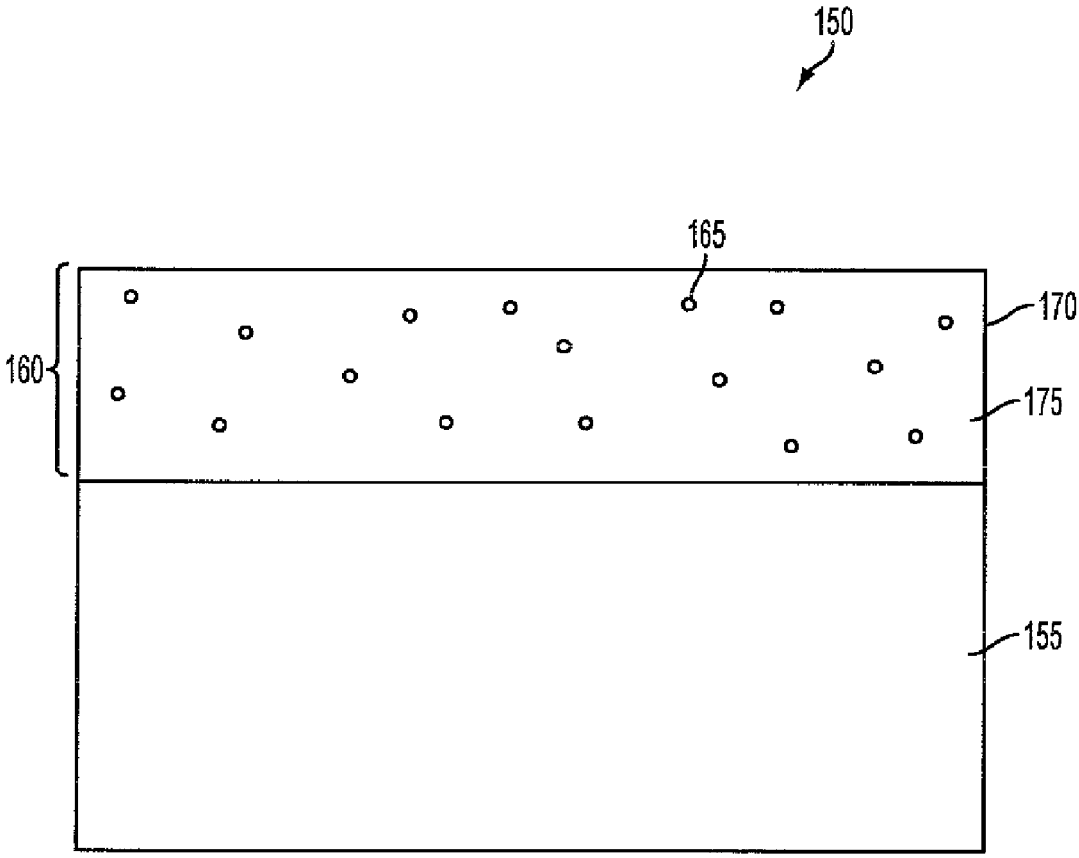
FIG. 1B depicts a cross-section of an exemplary photoreceptor of an imaging device according to the present teachings.

Referring to FIG. 1B, depicted is a detailed cross-section of an exemplary photoreceptor 150 and corresponding CTL according to the present embodiments. The photoreceptor 150 can be drum-shaped as described herein, or can be other shapes or configurations. The photoreceptor 150 can comprise an electroconductive substrate 155 and a photosensitive layer 160. According to embodiments, the photosensitive layer 160 can be a CTL 170 in which a charge generation material 175 and a copolymer 165 can be dispersed. The CTL 170 can comprise a resin having a charge transport ability or a mixture of a low molecular weight charge transport compound and a binder resin. The charge generation material 175 can generate a charge carrier and send the charge carrier to the CTL 170, where the charge carrier can transported, as conventionally understood. It should be appreciated, though, that the CTL 170 can comprise other materials with a charge transport ability.

Figure 2:
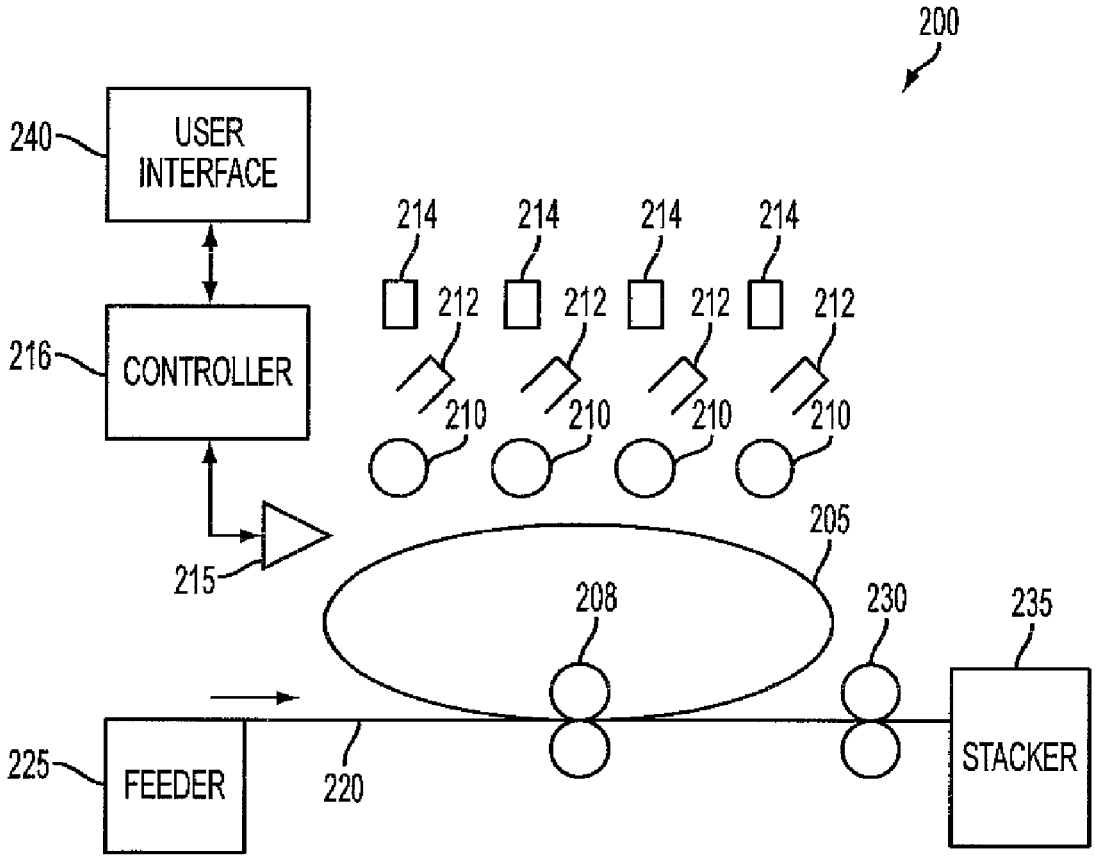
FIG. 2 depicts an exemplary imaging device for diagnosing a photoreceptor according to the present teachings.

Referring to FIG. 2, depicted is an exemplary imaging device 200 for diagnosing a photoreceptor according to the present embodiments. It should be appreciated that the imaging device 200 and components thereof as depicted in FIG. 2 are merely exemplary and can comprise different combinations and locations of components.

The imaging device 200 can comprise an intermediate belt 205, a set of photoreceptors 210, a set of chargers 212, and a set of scanning units 214. The photoreceptors 210 can be cylindrically shaped members and can be disposed in a rotatable manner, although other configurations are envisioned. In embodiments, each of the photoreceptors 210 can correspond to different colors of toner to be disposed on substrates. The chargers 212 can be disposed near the photoreceptors 210 and can uniformly deposit a negative electric charge on a surface of the photoreceptors 210. According to the present embodiments, the negative electric charge can fail to deposit in any locations of the photoreceptors 210 where CDS defects exist because the charge carrying capacity associated with the CDS defects can have been reduced or eliminated.

The scanning units 214 can also be disposed near the photoreceptors 210 and can be configured to scan and expose the surface of the photoreceptors 210 based on image information read from a controller 216. By being scanned and exposed by the scanning units 214, a portion of the electric charge on the surface of the photoreceptors 210 can be removed, based on the image information, to form an electrostatic latent image on the surface of the photoreceptors 210. Toner from toner cartridges (not shown in figures) can be transferred to the photoreceptors 210 to form toner images on the photoreceptors 210 based on the electrostatic latent images. In particular, positively-charged toner particles can be attracted to negatively-charged areas of the electrostatic latent image on the photoreceptors 210. The toner images developed on the photoreceptors 210 can be transferred to the intermediate belt 205.

The imaging device can further comprise a feeder 225, a paper path 220, a transfer roller 208, a fuser roller 230, and a stacker 235. In operation of the imaging device 200, a document or substrate can be retrieved from the feeder 225 and can transfer through the paper path 220 in the direction as indicated in FIG. 2. The substrate can receive the toner image from the intermediate belt 205 via the transfer roller 208 upon contact with the transfer roller 208. The substrate can transfer through the fuser roller 230 to fuse the toner image to the substrate, and can transfer to the stacker 235 for storage or retrieval.

The imaging device 200 can further comprise a sensor 215 disposed in proximity to the intermediate belt 205. In embodiments, the sensor 215 can be a full width array (FWA) or another type of scanner or sensor. The sensor 215 can be configured to sense the toner image on the intermediate belt 205 that was transferred from the photoreceptors 210. More particularly, the sensor 215 can sense areas of the intermediate belt 205 that comprise toner particles and areas of the intermediate belt 205 that do not comprise toner particles. In embodiments, timing signals can be used to align image data sensed by the sensor 215 with the functions of the imaging device 200. In embodiments, the sensor 215 can be disposed in other areas of the imaging device 200, and can be configured to sense other components, such as, for example, the photoreceptors 210, the printed substrates, and/or the like. Further, in embodiments, the sensor 215 can collect, measure, and/or analyze the sensed data, or can provide the sensed data to the controller 216. In further embodiments, the controller 216 can measure, perform calculations on, and/or analyze the sensed data received from the sensor 215, and can output the data to a user interface 240 such as, for example, a graphical user interface (GUI).

According to the present embodiments, a diagnostic cycle can be entered into whereby a set number of blank documents or substrates can be processed and outputted by the imaging device 200. In particular, the chargers 214 can deposit electric charge on the photoreceptors 210 and the scanning units 214 can act to do nothing or can otherwise be inactive such that no charge is neutralized from the surface of the photoreceptors 210. Therefore, the only locations on the surface of the photoreceptors 210 without a negative charge can be locations where CDS defects exist. Thus, toner particles can attach to the photoreceptors 210 at locations of CDS defects, and the CDS defects can act to produce visible spots or particles of toner on the printed substrates. Further, the sensor 215 can sense any toner disposed on the intermediate belt 205 which can indicate areas of CDS defects in the photoreceptors 205. In embodiments, the toner disposed on the intermediate belt 205 can be a background toner signal or noise that can have a random location from photoreceptor revolution to revolution.

According to the present embodiments, the diagnostic cycle can be repeated a set number of times whereby a set number of blank substrates can be processed and outputted by the imaging device 200. The diagnostic cycle can be repeated so that the CDS defects can be filtered from the background noise to accurately determine the size and location of the CDS defects. In particular, the CDS defects can be recorded in the same location on each diagnostic cycle, as opposed to the background noise, which is typically random for each diagnostic cycle. Therefore, the cumulative CDS defect recordations will be more apparent than those of the background noise over multiple cycles.

Referring to FIGS. 3A-3D, depicted are graphs showing data collection and processing according to the diagnostic cycles as described herein. The diagnostic cycles were conducted in an environment with a 40 mm drum photoreceptor and a FWA sensor. Further, the FWA sensor was disposed in proximity to an intermediate belt and was configured to detect and capture any toner image on the intermediate belt. A simulation of 30 revolutions of the photoreceptor was made with simulated CDS defects and background noise injected into the data. A PCIP was performed on the image data of the simulation to reduce the level of the background noise. Further, a CFAR process was applied to the image data whereby a sliding local window was used to determine a local detection threshold in the image data. The local detection threshold was applied to the image data to locate peaks in a signal, which can indicate locations of CDS defects in the photoreceptor.

Figure 3A:
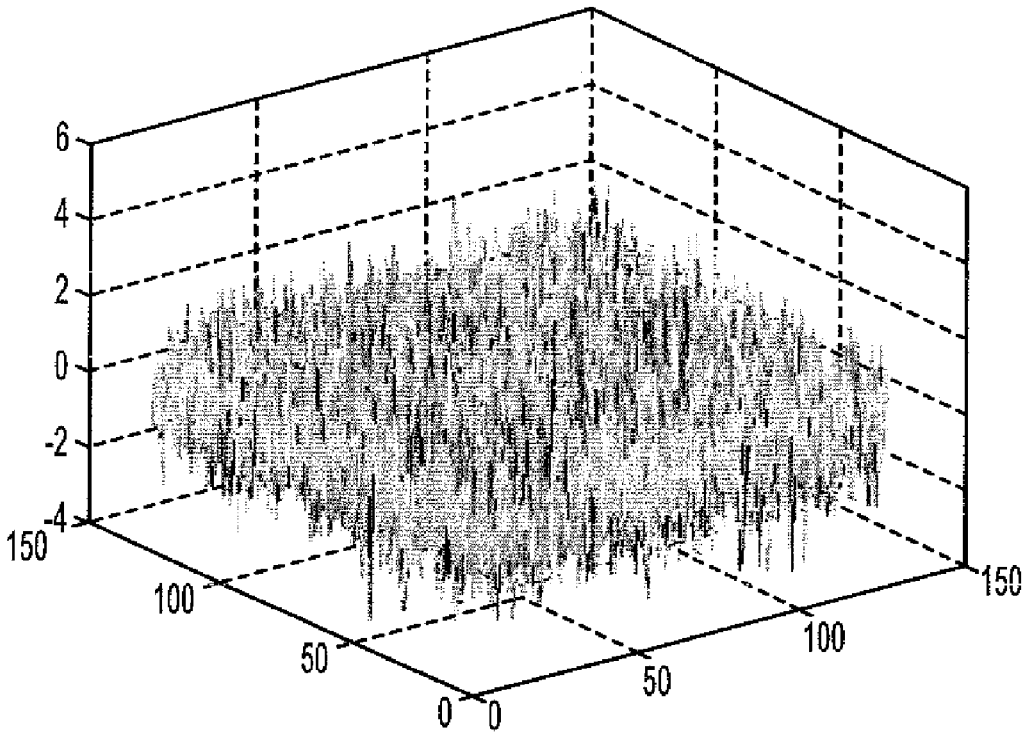
FIGS. 3A-3D depict graphs of data collection and processing according to the present teachings.
Figure 3B:
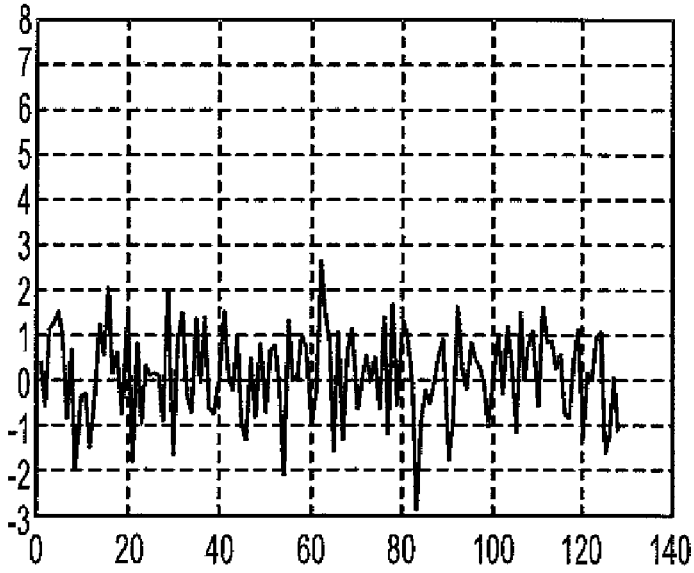

FIG. 3A depicts an approximate 10 mm by 10 mm area of two-dimensional FWA image data detected from one revolution of the photoreceptor. It can be seen in FIG. 3A that, after the one revolution, detected CDS defects and background noise cannot be distinguished from each other. FIG. 3B depicts a one-dimensional transformation of the two-dimensional data depicted in FIG. 3A. Similar to FIG. 3A, it can be seen in FIG. 3B that, after the one revolution, detected CDS defects and background noise cannot be distinguished from each other.

Figure 3C:
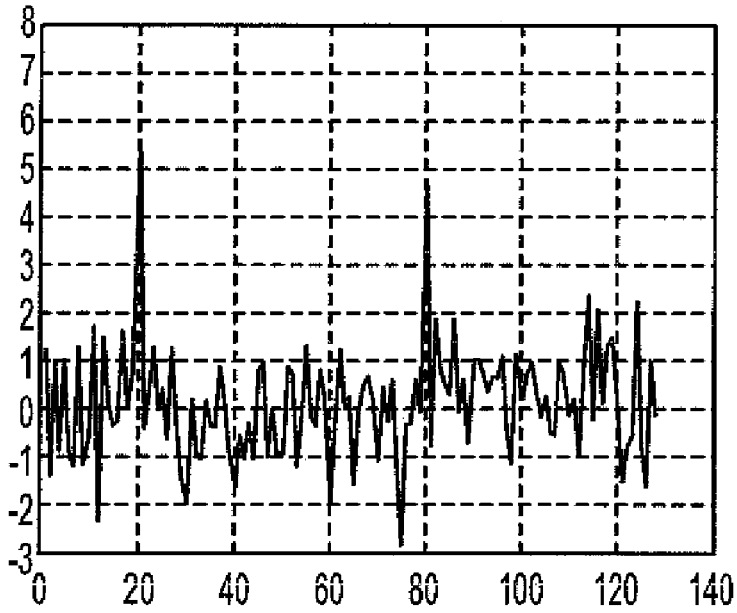
Figure 3D:
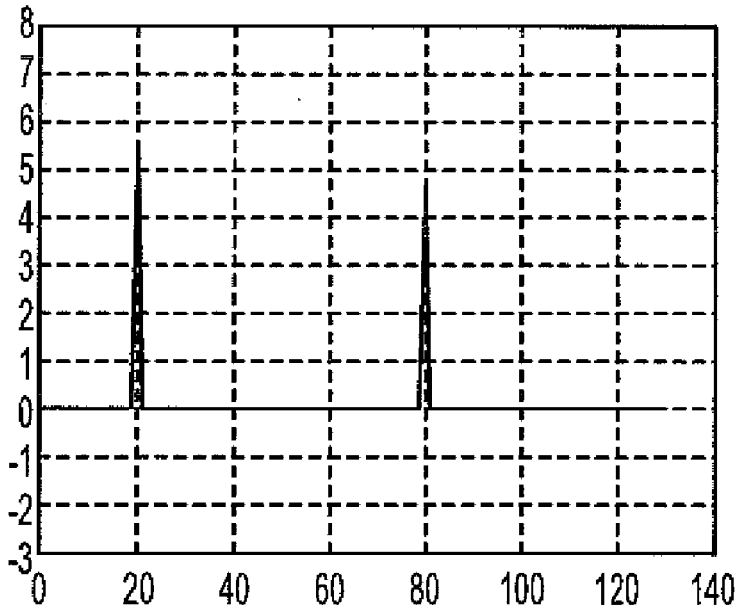

FIG. 3C depicts image data sensed and collected after 30 revolutions of the photoreceptor, and after the PCIP is performed on the image data, as discussed herein. In particular, the PCIP can reduce the level of the background noise because the CDS defects can be in a consistent location in any given cycle and the background noise can be in a random location in any given cycle. As shown in FIG. 3C, the CDS defects can have a higher amplitude than the background noise. In particular, as shown in FIG. 3C, CDS defects are located at locations 20 and 80 of the x-axis. FIG. 3D depicts the data of FIG. 3C after applying a CFAR detection algorithm, as discussed herein. In particular, the CFAR detection algorithm uses a sliding local window to determine a local detection threshold in the image data, and applies the local detection threshold to the image data to locate peaks in the image data. Similar to FIG. 3C, the data in FIG. 3D indicates that the amplitudes at locations 20 and 80 of the x-axis exceeded the local detection threshold and are therefore marked as locations of CDS defects.

Figure 4:
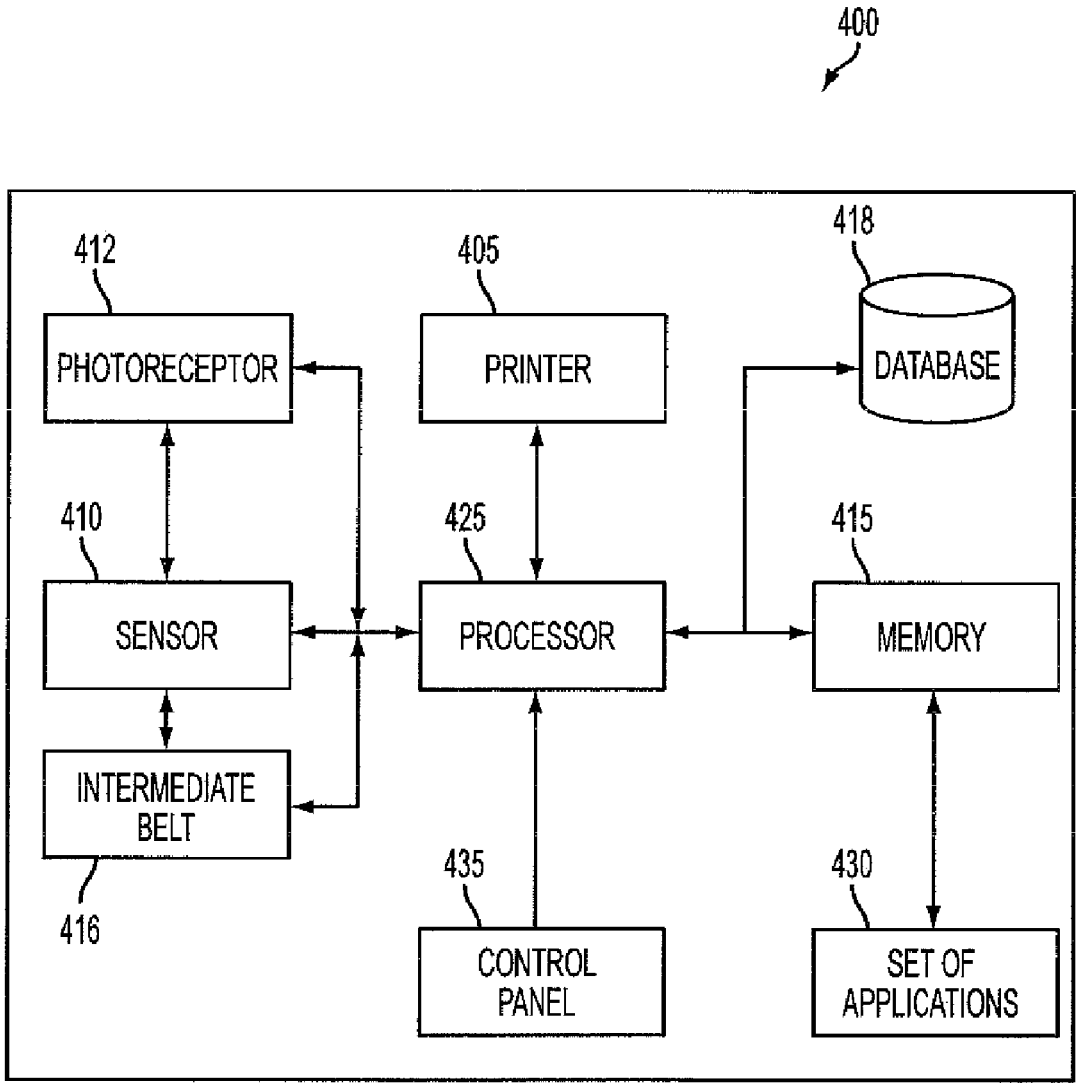
FIG. 4 depicts an exemplary block diagram of an imaging device according to the present teachings.

FIG. 4 depicts an exemplary block diagram of an imaging device 400. The imaging device 400 generally refers to a dual-mode imaging device that can print, copy, fax, scan, and perform similar operations. However, it should be appreciated that the imaging device 400 can be a standalone device capable of handing the functions associated with CDS defect detecting, and photoreceptor diagnosing, as described herein. Generally, these devices can comprise a network connection, such as, for example, a local area connection (LAN) such as an Ethernet interface, or a modem that can connect to a phone line (not shown in figures).

The imaging device 400 can comprise a printer 405, a sensor 410, a memory 415, and a photoreceptor 412. The printer 405 can output image data onto various substrates. In embodiments, the imaging device 400 can enter a diagnostic routine whereby the printer 405 can output a set number of blank substrates. The sensor 410 can detect any CDS defects or background noise on various components of the imaging device 400 such as, for example, the photoreceptor 412, an intermediate belt 416, outputted substrates, and/or other components, as described herein. In embodiments, the sensor 410 can sense CDS defect and background noise data during each cycle of the diagnostic routine.

The imaging device 400 can further comprise a processor 425 and a set of applications 430. The set of applications 430 can be initiated by a user, administrator, operator, and/or the like and can be executed on the processor 425 to direct the functions of the imaging device 400 and components thereof, as described herein. In embodiments, the processor 425 can write data to and retrieve data from the memory 415 and/or a database 418. According to the present embodiments, the set of applications 430 in combination with the processor 425 can obtain or retrieve image measurement data from the memory 415 and/or the sensor 410. For example, the processor 425 can retrieve any data related to a number or size of CDS defects or background noise measured by the sensor 410. The set of applications 430 in combination with the processor 425 can use the retrieved data to perform calculations and/or diagnose a replacement need of the photoreceptor 412 and/or the imaging device 400, according to the present embodiments.

The processor 425 can be coupled to a control panel 435 including, for example, a touchpad or series of buttons which can allow a user a control and a user-readable setup and status screen. In embodiments, a GUI associated with the set of applications 430 can display on the control panel 435. In use, the user can select one or more functions from a number of different functions provided by the imaging device 400 through the use of the control panel 435. For example, the user can select to diagnose a replacement need of the photoreceptor 420 via the control panel 435.

Figure 5:
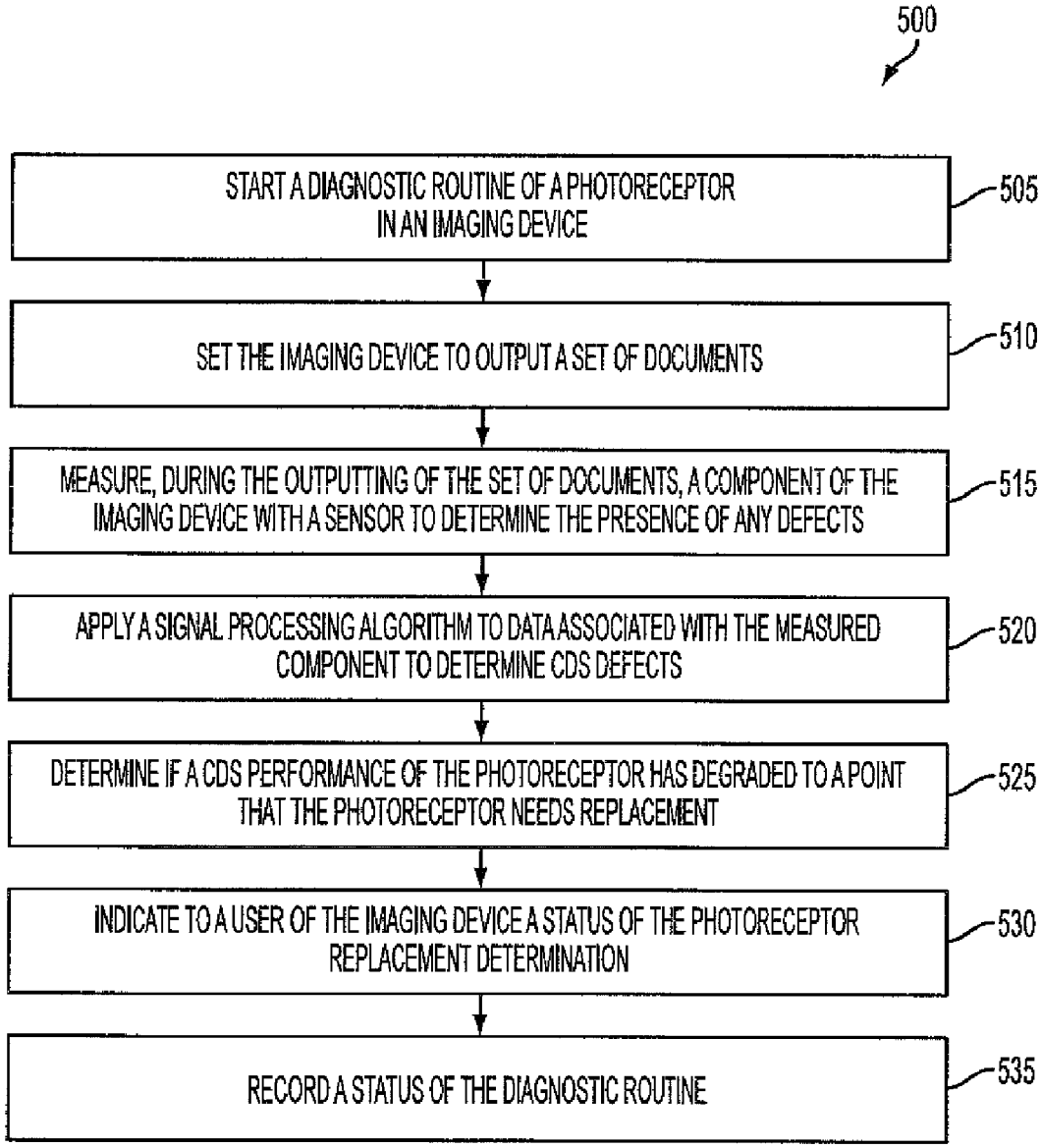
FIG. 5 depicts an exemplary flow diagram diagnosing a photoreceptor according to the present teachings.

Referring to FIG. 5, a present embodiment for an exemplary method 500 for diagnosing a replacement need of a photoreceptor of a device is depicted. It should be appreciated that any combination of the mechanical and electronic components of the imaging device 400 as described with respect to FIG. 4 can perform the steps of the method 500 such as, for example, the processor 425, the photoreceptor 412, the sensor 410, the memory 415, the set of applications 430, and other components. It should be appreciated that the method 500 can be repeated at any time during the life of the photoreceptor or at fixed or variable intervals throughout the life of the photoreceptor.

In 505, a diagnostic routine of a photoreceptor in an imaging device can start. In embodiments, the diagnostic routine can be started on a client machine or device by an administrator, owner, operator, or another user of the imaging device or components thereof. In 510, the imaging device can be set to output a set of documents or substrates. In embodiments, the number of outputted documents can be any integer, such as, for example, in a range of 2 to 1,000, or other values, and can be set by an administrator, owner, operator, or another user of the imaging device or components thereof. In embodiments, the outputted set of documents can be blank except for any spots or particles of toner caused by CDS defects or background noise.

In 515, a component of the imaging device can be measured with a sensor during the outputting of the set of documents to determine the presence of any defects. In embodiments, the defects can be CDS defects or background noise. In embodiments, the component to be measured can be a belt or drum of the photoreceptor, an intermediate belt or drum, or the outputted set of substrates, as described herein. In embodiments, the sensor can be a full width sensor such as a full width array (FWA) contact image sensor that can comprise a flatbed scanner. In embodiments, timing signals can be used to align image data of the sensed component with the photoreceptor.

In 520, a signal processing algorithm can be applied to data associated with the measured component to determine CDS defects. In embodiments, any CDS defects in the measured data can be filtered from any background noise in the measured data. In embodiments, the CDS defects can be detected using a PCIP and/or a CFAR detection process, as described herein. In embodiments, the signal processing algorithm can determine the amount of and area covered by the CDS defects. In 525, the systems and methods can determine if a CDS performance of the photoreceptor has degraded to a point that the photoreceptor or components thereof need replacement. In embodiments, a multi-level threshold scheme can be used to indicate the urgency of the replacement. For instance, a first level can cause a warning, a second level can indicate that a new photoreceptor should be ordered, and a third level can indicate that a new photoreceptor should be replaced. It should be appreciated that other levels and/or warnings are envisioned.

In 530, the systems and methods can indicate to a user, operator, administrator, or the like a status of the photoreceptor replacement determination. In embodiments, the systems and methods can output a report of the determination to the user, operator, administrator, or the like, and the output report can indicate the level of the multi-level threshold scheme, as discussed herein. In further embodiments, a replacement order can be automatically or manually submitted to a supplier for a replacement of the photoreceptor or other components. Further, the user, operator, administrator, or the like of the imaging device can be prompted to order a replacement photoreceptor. In 535, the data associated with the diagnostic test can be recorded, updated, and/or stored. In embodiments, the data can be written to any form of storage device or can be outputted to a user via, for example, a GUI.

Notwithstanding that the numerical ranges and parameters setting forth the broad scope of the embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

While the embodiments have been illustrated with respect to one or more implementations, alterations and/or modifications can be made to the illustrated examples without departing from the spirit and scope of the appended claims. In addition, while a particular feature of the embodiments may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the embodiments will be apparent to those skilled in the art from consideration of the specification and practice of the embodiments disclosed herein. It is intended that the specification and examples be considered as exemplary only, with a true scope and spirit of the embodiments being indicated by the following claims.

What is claimed is:

1. A method of diagnosing a photoreceptor of a device, the method comprising:

executing a set of cycles of the device;

sensing a component associated with the device during each of the set of cycles to establish defect data;

processing the defect data to identify one or more charge deficient spots (CDS) in the defect data, wherein processing the defect data to identify the one or more CDS comprises performing a photoreceptor coherent integration process (PCIP) on the defect data; and determining whether the photoreceptor needs replacement based on the identified one or more CDS.

2. The method of claim 1, wherein the component associated with the device is one of an intermediate belt, the photoreceptor, or an outputted substrate.

3. The method of claim 1, wherein processing the defect data to identify the one or more charge deficient spots (CDS) further comprises performing a constant false alarm rate (CFAR) detection on the defect data.

4. The method of claim 3, wherein performing the constant false alarm rate (CFAR) detection on the defect data comprises:

comparing the processed defect data with a local threshold amount; and identifying the one or more charge deficient spots (CDS) based on the comparison.

5. The method of claim 1, wherein the component associated with the device is sensed with a full width array (FWA).

6. The method of claim 1, further comprising providing an output report based on the determination of whether the photoreceptor needs replacement.

7. The method of claim 6, wherein the output report indicates an urgency level for the photoreceptor replacement.

8. The method of claim 1, wherein the determining of whether the photoreceptor needs replacement is done at fixed or variable intervals during a life of the photoreceptor.

9. The method of claim 1, wherein the defect data is sensed from a same location on the photoreceptor during each of the set of cycles, and wherein performing the photoreceptor coherent integration process (PCIP) on the defect data comprises combining the defect data.

10. The method of claim 1, further comprising submitting a replacement order to a supplier for a replacement of the photoreceptor based on the determination of whether the photoreceptor needs replacement.

11. A system for diagnosing a photoreceptor of a device, the system comprising:

the device configured to execute a set of cycles;

a sensor configured to a scan a component associated with the device during each of the set of cycles to establish defect data; and a processor configured to analyze the defect data to identify one or more charge deficient spots (CDS) in the defect data by performing a photoreceptor coherent integration process (PCIP) on the defect data; and determine whether the photoreceptor needs replacement based on the identified one or more CDS.

12. The system of claim 11, wherein the component associated with the device is one of an intermediate belt, the photoreceptor, or an outputted substrate.

13. The system of claim 11, wherein the processor further analyzes the defect data by performing a constant false alarm rate (CFAR) detection on the defect data.

14. The system of claim 13, wherein the constant false alarm rate (CFAR) detection is performed by:

comparing the processed defect data with a local threshold amount; and identifying the one or more charge deficient spots (CDS) based on the comparison.

15. The system of claim 11, wherein the component associated with the device is sensed with a full width array (FWA).

16. The system of claim 11, wherein the processor is further configured to provide an output report based on the determination of whether the photoreceptor needs replacement.

17. The system of claim 16, wherein the output report indicates an urgency level for the photoreceptor replacement.

18. The system of claim 11, wherein the replacement need of the photoreceptor is determined at fixed or variable intervals during a life of the photoreceptor.

19. The system of claim 11, wherein the processor is further configured to submit a replacement order to a supplier for a replacement of the photoreceptor based on the determination of whether the photoreceptor needs replacement.

20. The system of claim 11, wherein the defect data is sensed from a same location on the photoreceptor during each of the set of cycles, and wherein performing the photoreceptor coherent integration process (PCIP) on the defect data comprises combining the defect data.

21. A method of diagnosing a photoreceptor of a device, the method comprising:

executing a set of cycles of the device, wherein each cycle comprises:

setting the device to output at least one document without any exposure; and after setting the device to output at least one document without any exposure, sensing a component associated with the device before executing a subsequent cycle of the set of cycles to establish defect data;

processing the defect data to identify one or more charge deficient spots (CDS) in the defect data; and determining whether the photoreceptor needs replacement based on the identified one or more CDS.

22. The method of claim 1, wherein processing the defect data to identify the one or more charge deficient spots (CDS) comprises performing a photoreceptor coherent integration process (PCIP) on the defect data.

* * * * *